United States Patent [19]

Purzycki et al.

[11] 4,157,224

[45] Jun. 5, 1979

[54] RIBBON ADVANCING MECHANISM

[75] Inventors: Alfred Z. Purzycki, Arlington Heights; John E. Randolph, Palatine, both of Ill.

[73] Assignee: Teletype Corporation, Skokie, Ill.

[21] Appl. No.: 822,039

[22] Filed: Aug. 5, 1977

[51] Int. Cl.[2] ..... B41J 33/14

[52] U.S. Cl. ..... 400/233; 400/196; 400/234

[58] Field of Search ..... 400/124, 194, 195, 196, 400/196.1, 229, 233, 234

[56] References Cited

U.S. PATENT DOCUMENTS

| | | | |
|---|---|---|---|
| 1,949,107 | 2/1934 | Mosfelt et al. | 400/233 |
| 1,958,764 | 5/1934 | Mosfelt et al. | 400/233 X |
| 3,283,876 | 11/1966 | Kern | 400/229 X |
| 3,367,470 | 2/1968 | Berill | 400/233 X |
| 3,401,783 | 9/1968 | Norwood et al. | 400/229 X |
| 3,726,381 | 4/1973 | Murphy | 400/233 X |
| 3,977,512 | 8/1976 | Teagarden et al. | 400/229 X |
| 3,982,622 | 9/1976 | Bellino et al. | 400/124 |
| 4,046,247 | 9/1977 | Laspesa et al. | 400/196 |

FOREIGN PATENT DOCUMENTS

| | | | |
|---|---|---|---|
| 1203290 | 10/1965 | Fed. Rep. of Germany | 400/194 |

*Primary Examiner*—Ernest T. Wright, Jr.

*Attorney, Agent, or Firm*—W. K. Serp; J. C. Albrecht

[57] ABSTRACT

In order to advance an inked ribbon in a printing apparatus in which a printing carriage mechanism moves across the width of a platen, one-way brakes are placed on ribbon guide rollers on the printing carriage mechanism to permit relative movement between the printing carriage mechanism and the inked ribbon as the printing carriage mechanism is advancing from left-to-right across the paper. One-way brakes are placed on return rollers in the ribbon path in order to prevent the inked ribbon from moving with respect to the platen as the printing carriage mechanism is moving from left-to-right across the paper. When the printing carriage mechanism moves from right-to-left in order to return to the left-hand margin, the one-way brakes on the ribbon guide rollers on the printing carriage mechanism apply substantial friction to the inked ribbon and drag the inked ribbon with the printing carriage mechanism as the printing carriage mechanism returns from right-to-left. In this same motion the return rollers rotate freely to allow the inked ribbon to move in accordance with the printing carriage mechanism motion.

7 Claims, 3 Drawing Figures

RIBBON ADVANCING MECHANISM

FIELD OF THE INVENTION

The present invention relates to printing apparatus and more particularly to a system for guiding and controlling the movement of an inked ribbon through the printing apparatus.

BACKGROUND OF THE INVENTION

In printing apparatus of the type disclosed in U.S. Pat. No. 3,982,622, granted to J. A. Bellino et al. on Sept. 28, 1976, paper mounted on a typing platen receives printed impressions from a printing mechanism which moves from left to right across the face of the platen. An inked ribbon is imposed between the printing mechanism and the paper and is squeezed against the paper by the printing mechanism in shapes which, in the aggregate, form alphanumeric characters on the paper. The inked ribbon must periodically be renewed in order to maintain an even density of printing on the paper. U.S. Pat. No. 4,046,247 issued Sept. 6, 1977, entitled "Printer Ribbon Cartridge", in the name of R. E. LaSpesa et al. and commonly assigned herewith, discloses a ribbon cartridge and a ribbon routing system for guiding and reinking a ribbon. In the apparatus of the LaSpesa et al. patent, an inked ribbon cartridge is so manipulated as to draw an inked ribbon out of the cartridge and position the ribbon in front of the printing mechanism. Friction means are provided on the printing mechanism to apply a drag on the inked ribbon whenever the printing mechanism on its traversing carriage is moved from left to right or from right-to-left across the face of the platen and width of the paper. A one-way brake, housed within the ribbon cartridge which comprises one set of return rollers for ribbon routing, assures that ribbon is advanced unidirectionally upon movement of the carriage from right-to-left in a carriage-return operation but is held from movement as the carriage moves from left-to-right in the normal printing operation.

SUMMARY OF THE INVENTION

In accordance with the present invention, a printing carriage mechanism equipped with at least one ribbon guiding roller is provided with a one-way brake on the ribbon guiding roller to apply friction to the inked ribbon as the printing carriage mechanism moves in one direction but not to apply friction to the inked ribbon as the printing carriage is moved in the opposite direction. At least one return roller is provided having a one-way brake to apply friction to the inked ribbon in a sense opposite to that of the carriage roller such that the inked ribbon moves only when the carriage roller applies friction to the inked ribbon and is held stationary by the return roller when the carriage mounted roller is free to rotate.

BRIEF DESCRIPTION OF THE DRAWING

A more complete understanding of the present invention may be had by referring to the following detailed description when considered in conjunction with the accompanying drawing wherein like reference numbers designate the same or similar parts throughout the several views in which.

DETAILED DESCRIPTION

Figure 1:
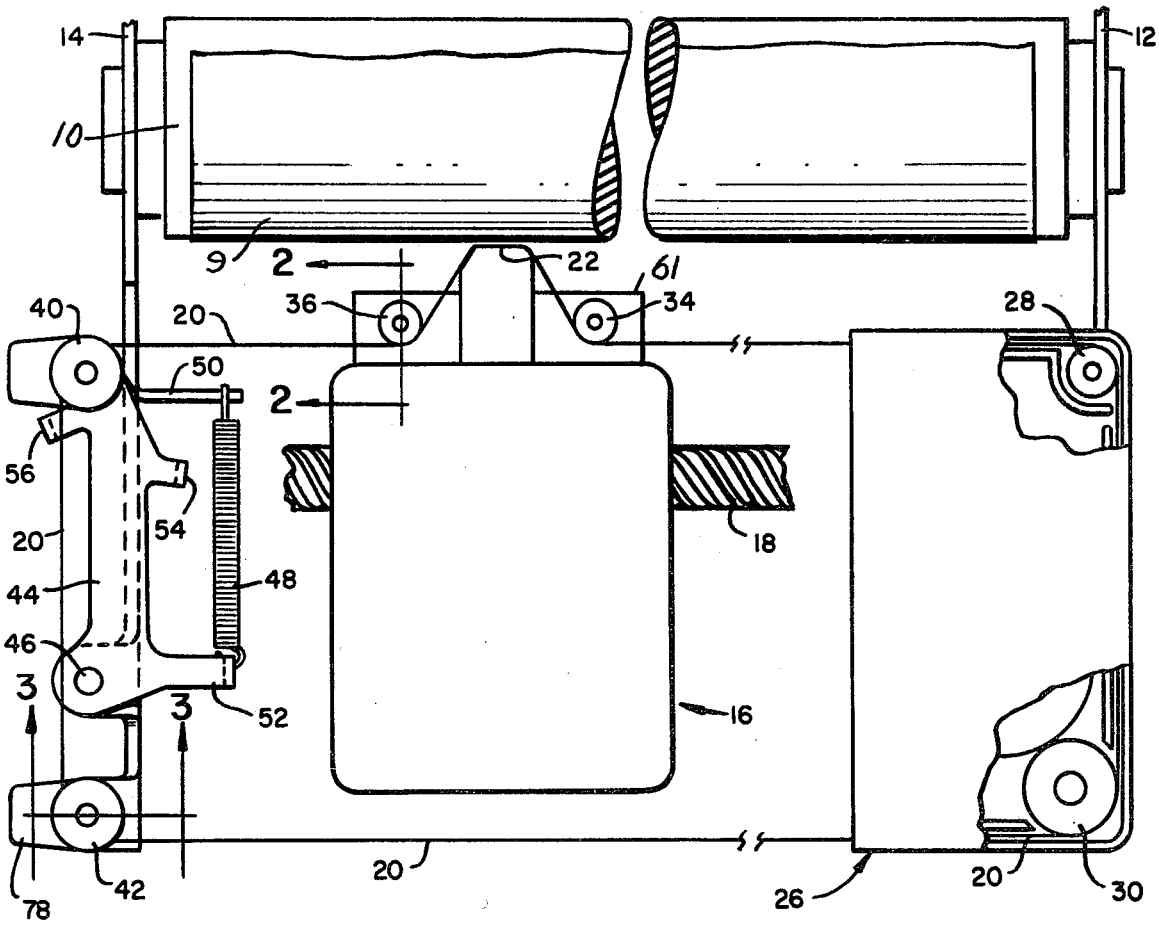
FIG. 1 is a schematic diagram depicting a generalized view of the top of a portion of a printer having a printing carriage mechanism and with an inked ribbon set in place with a ribbon cartridge and showing the environment of the present invention.

Referring now to the accompanying drawing and more particularly to FIG. 1, there is shown a partial schematic plan view of a printing apparatus similar to that shown in the abovementioned LaSpesa et al. patent. A record medium in the form of a paper 9 is mounted on a platen 10 which is rotatably mounted in a pair of side frames 12 and 14. A printing carriage mechanism 16 generally of the type shown in the abovementioned Bellino et al. patent, is mounted for translation across the width of the platen 10 by means of a spiral screw 18 which, by its rotation, translates the printing carriage mechanism 16 from right-to-left and vice-versa. An inked ribbon 20 is threaded in a circuit path passing between a printing face 22 on the printing carriage mechanism 16 and the paper 9 wrapped about the platen 10. Preferably, printing wires (not shown) within the printing carriage mechanism 16 drive the inked ribbon 20 into the paper 9 for forming indicia thereon.

The ribbon 20 is supplied for use in the illustrated printer in cartridges of the type described in the abovementioned LaSpesa et al. patent. One of these cartridges, referred to by the reference number 26, is mounted on the right side frame 12 and contains a pair of return rollers 28 and 30. The return rollers 28 and 30 are freely rotatable within the cartridge 26 and provide a path for returning the inked ribbon 20 through a full 180°.

The inked ribbon 20 is stretched across the printing face 22 by a pair of carriage-mounted rollers 34 and 36. The inked ribbon 20 is also returned through 180° at the left side of the platen 10 by a pair of return rollers 40 and 42. The return roller 42 is mounted for free rotation with respect to the left side frame 14. However, the other return roller 40 is mounted on a movable support lever 44 that is rotatably mounted on a pivot 46 that is also firmly mounted to the frame 14.

A spring 48 is fixed at one end to a tab 50 which is a part of the side frame 14. The other end of the spring 48 is attached to an arm 52 on the movable support lever 44. The movable support lever 44 is provided with two stop ears 54 and 56 to prevent its excessive movement.

In the operation of the printer, the movable support lever 44 responds to the spring 48 and tends to apply tension on the inked ribbon 20 by rotating in a counterclockwise direction as viewed in FIG. 1 under the urging of the spring 48 so as to move the return roller 40 to the left, thereby applying a proper amount of tension to the inked ribbon 20. The stop ear 54 can engage a portion of the left side frame 14 so as to prevent excessive leftward movement of the return roller 40. Similarly, when a higher than desired amount of tension is applied on the portion of the inked ribbon 20 that extends from the roller 36 to the return roller 40, the spring 48 yields, and the movable support lever 44 rotates in a clockwise direction under the tension in the inked ribbon 20 so as to prevent application of excessive tension to the inked ribbon 20. However, the stop ear 56 prevents excessive rightward migration of the return roller 40.

ONE-WAY BRAKES

The rollers 34 and 36 are provided with simple one-way brakes to permit free rotation of the rollers 34 and 36 in the clockwise direction as viewed in FIG. 1 but to prevent counterclockwise rotation of the rollers 34 and 36. Consequently, whenever the lead screw 18 causes the printing carriage mechanism 16 to move from left-to-right across the face of the platen 10, the inked ribbon 20 is free to move relative to the printing carriage mechanism 16 as the rollers 34 and 36 freely rotate in the clock-wise direction. Consequently, a new portion of the inked ribbon 20 is used each time that the printing carriage mechanism 16 attempts to print some indicium on the paper 9 that is wrapped around the platen 10. Therefore, when the printing carriage mechanism 16 travels in a rightward direction, the inked ribbon 20 stays stationary with respect to the platen 10. The only movement of the inked ribbon 20 is towards the printing face 22 and back away from the platen 10 as the printing carriage mechanism 16 moves to the right.

However, as the lead screw 18 moves the printing carriage mechanism 16 in a leftward direction during a "carriage return" operation, the rollers 34 and 36 are prevented by their one-way brakes from counterclockwise rotation and serve to greatly increase the friction between the inked ribbon 20 and the printing carriage mechanism 16. Consequently, as the printing carriage mechanism 16 moves to the left, it drags the inked ribbon 20 with it, thereby bringing a fresh section of the inked ribbon 20 from the cartridge 26 into position in front of the platen 10.

A pair of one-way brakes are also used with the rollers 40 and 42 in order to permit the rollers 40 and 42 to rotate only in the counterclockwise direction as viewed in FIG. 1. Therefore, as the printing carriage mechanism 16 is moving from left-to-right across the platen 10 in a normal printing operation, the one-way brakes prevent the return rollers 40 and 42 from rotating. The stationary return rollers 40 and 42 produce a substantial amount of friction with the tensioned inked ribbon 20. Consequently, any slight friction between the inked ribbon 20 and any part of the printing carriage mechanism 16 is easily overcome as the rollers 34 and 36 freely rotate upon movement of the printing carriage mechanism 16 from left-to-right. This assures that the inked ribbon 20 remains stationary as the printing carriage mechanism 16 moves to the right in the normal printing operation.

However, when the printing carriage mechanism 16 moves to the left and the inked rollers 34 and 36 cause the ribbon 20 to be gripped by the printing carriage mechanism 16, the rollers 40 and 42 freely rotate in the counterclockwise direction in order to allow the portion of the inked ribbon 20 closest to the platen 10 to freely move with respect to the platen 10, in a leftward direction.

It might be expected that the inked ribbon 20 would become depleted of ink rather rapidly since it is only somewhat more than twice as long as the platen 10. However, in accordance with the teachings of the abovementioned LaSpesa et al. patent, the cartridge 26 is equipped with provision for reinking the inked ribbon 20 as it passes therethrough.

Figure 2:
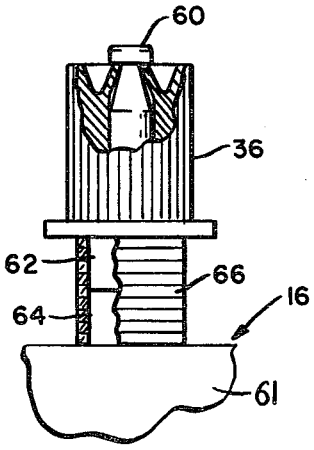
FIG. 2 is a detailed partial cross-sectional view taken along the line 2—2 of FIG. 1 of the inked-ribbon guide rollers that are mounted on the printing carriage mechanism showing the one-way brake used therewith.

Referring now to FIG. 2, the roller 36 is freely rotatable about a pin 60 that is firmly mounted in a framework 61 of the printing carriage mechanism 16. The roller 36 has a depending extension 62. An identical but upstanding extension 64 is formed as an integral part of the framework 61 of the printing carriage mechanism 16. As the roller 36 rotates about the pin 60, the extension 62 rotates with it. However, the extension 64 remains stationary with respect to the framework 61 of the printing carriage mechanism 16 and also with respect to the pin 60. A flat sided coil spring 66 formed from a square or rectangular wire is wound helically around both of the extensions 62 and 64, as is well-known in the art of coilsprings, one-way brakes and clutches. Therefore, as the two extensions 62 and 64 attempt relative rotation in one direction, the coil spring 66 is unwound and therefore permits such relative rotation with almost no friction. However, as an attempt is made to relatively rotate the extentions 62 and 64 in the opposite direction, the coil spring 66 tightens about both of the extensions 62 and 64 and binds them tightly together, preventing such relative rotation.

Figure 3:
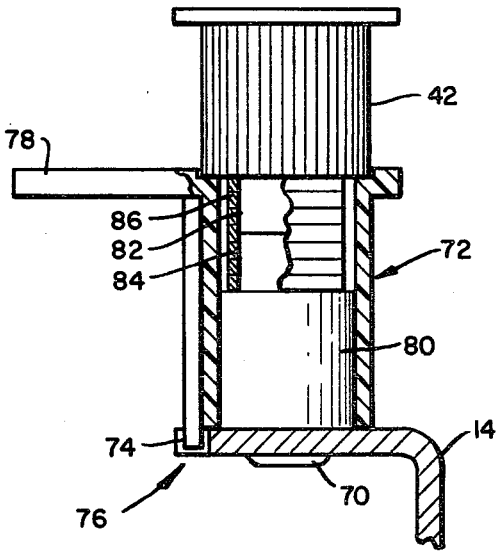
FIG. 3 is a partial cross-sectional view taken along the line 3—3 of FIG. 1 of a return roller showing the one-way brake and its application thereto.

Referring now to FIG. 3 of the accompanying drawing, a pin 70, most of which is not shown, is firmly mounted in either a separate bracket bolted to the left side frame 14 or to a bent-over portion of the left side frame 14. The pin 70 provides a fixed pivot about which the return roller 42 is freely rotatable. A cylindrical support 72 is loosely mounted on the pin 70 and includes a tab 74 which engages an opening 76 in the bent-over portion of the left side frame 14 in order to prevent the cylindrical support 72 from rotating about the pin 70. A shelf 78 upon the cylindrical support 72 is provided for facilitating insertion of a new inked ribbon 20 and a new cartridge 26 in accordance with the abovementioned LaSpesa et al. patent.

A cylindrical post 80 is mounted around the pin 70 and is immovable with respect to the pin 70 and the bent-over portion of the left side frame 14. Alternatively, the pin 70 and the cylindrical post 80 can be integrally-formed as a single part. An extension 82 depends from and is an integral part of the return roller 42. An upstanding extension 84 from the cylindrical post 80 is of identical diameter as the extention 82, but the extension 84 is also immovable with respect to the left side frame 14. A flat coil spring 86 formed of square or rectangular wire is wound around both extensions 82 and 84. As in the case of the roller 36, the coil spring 86 permits the roller 42 to rotate in only one direction with respect to the left side frame 14. However, whereas the coil spring 66 permits the roller 36 to rotate only in the clockwise direction with respect to the printing carriage mechanism 16 as viewed in FIG. 1, the coil 86 permits the return roller 42 to rotate only in the counterclockwise direction as viewed in FIG. 1.

Although this invention has been particularly shown and described with reference to a preferred embodiment thereof, it will be understood that various changes in form and detail may be made without departing from the spirit and scope of the invention as set forth in the following claims.

What is claimed is:

1. An improved apparatus for controlling the advance of an inked ribbon in a printing apparatus having a printing carriage mechanism that moves across the width of a record medium, having two edges, for printing indicia thereon, at least one roller rotatably mounted on the printing carriage mechanism for guiding the inked ribbon between the printing carriage mechanism and the record medium, and at least one return roller rotatably mounted near one of the two edges of the record medium for changing the direction of the inked ribbon, wherein the improvement comprises:

a one-way brake on the printing carriage roller to permit the printing carriage roller to rotate freely in one rotational direction but not in the other rotational direction so as to apply friction to and thus grip the inked ribbon when the printing carriage mechanism moves in one of its two directions but to apply minimum frictional drag on the inked ribbon as the printing carriage mechanism moves in the other of its two directions;

a one-way brake on the return roller to permit the return roller to rotate freely in one rotational direction which may differ from the one direction of the printing carriage roller but to prevent the return roller from rotating in the other rotational direction so as to apply maximum friction to and thus grip the inked ribbon when the printing carriage mechanism moves in the other of its two directions to prevent movement of the inked ribbon with respect to the record medium but to apply minimum frictional drag on the inked ribbon when the printing carriage mechanism moves in the one of its two directions, whereby the inked ribbon stays stationary with respect to the record medium as the printing carriage mechanism moves in the other of its two directions, but the inked ribbon moves with respect to the record medium as the printing carriage mechanism moves in the one of its two directions.

2. An apparatus for controlling the advance of an inked ribbon in accordance with claim 1 wherein there are two rollers rotatably mounted on the printing carriage mechanism for guiding the inked ribbon between the printing carriage mechanism and the record medium with both printing carriage rollers controlled by one-way brakes to permit both printing carriage rollers to rotate freely in the one rotational direction but not in the other rotational direction.

3. An apparatus for controlling the advance of an inked ribbon in accordance with claim 2 wherein there are two return rollers rotatably mounted near at least one edge of the record medium for changing the direction of the inked ribbon, both return rollers controlled by one-way brakes to permit both return rollers to rotate freely in only one rotational direction but to prevent both return rollers from rotating in the opposite rotational direction.

4. An apparatus for controlling the advance of an inked ribbon in accordance with claim 3 wherein one of the return rollers is mounted on a movable support that is spring biased to yield as the printing carriage mechanism moves in the other of its two directions.

5. An improved apparatus for controlling the advance of an inked ribbon in accordance with claim 1 wherein there are two return rollers rotatably mounted near at least one edge of the record medium for changing the direction of the inked ribbon, both return rollers controlled by one-way brakes to permit both return rollers to rotate freely in only one rotational direction but to prevent both return rollers from rotating in the opposite rotational direction.

6. An apparatus for controlling the advance of an inked ribbon in accordance with claim 5 wherein one of the return rollers is mounted on a movable support that is spring biased to yield as the printing carriage mechanism moves in the other of its two directions.

7. An apparatus for controlling the advance of an inked ribbon in accordance with claim 1 wherein the return roller is mounted on a movable support that is spring biased to yield as the printing carriage mechanism moves in the other of its two directions.

* * * * *